United States Patent [19]

Yeomans

[11] Patent Number: 4,700,902

[45] Date of Patent: Oct. 20, 1987

[54] DOCUMENT SHREDDING MACHINES

[75] Inventor: James T. Yeomans, Birmingham, United Kingdom

[73] Assignee: Ofrex Group Holdings PLC, West Drayton, United Kingdom

[21] Appl. No.: 807,973

[22] Filed: Dec. 13, 1985

[30] Foreign Application Priority Data

Dec. 13, 1984 [GB] United Kingdom ..... 8431429

[51] Int. Cl.[4] ..... B02C 23/00

[52] U.S. Cl. ..... 241/100; 241/101.2; 241/301

[58] Field of Search ..... 83/167; 241/100, 101.2, 241/235, 236, 242, 243, 285 R, 285 A, 285 B, 301

[56] References Cited

U.S. PATENT DOCUMENTS

| | | | |
|---|---|---|---|
| 444,798 | 1/1891 | Morgan | 241/100 |
| 2,620,988 | 12/1952 | Tellier | 241/100 X |
| 3,987,972 | 10/1976 | Gladwin | 241/100 X |

FOREIGN PATENT DOCUMENTS

| | | | |
|---|---|---|---|
| 520982 | 3/1931 | Fed. Rep. of Germany | 241/100 |

*Primary Examiner*—Timothy V. Eley
*Attorney, Agent, or Firm*—Vaden, Eickenroht, Thompson & Boulware

[57] ABSTRACT

A base unit for a document shredding machine comprising a frame like supporting structure providing an open-fronted stand which provides a horizontal surface on which a shredding machine may be placed. A bin of the base unit comprises a rear portion and a front portion which is wider than the rear portion, and when the bin is located within the supporting structure, side walls of the rear portion lie between support members of the frame structure and between side walls thereof, while the side walls of the front portion project into the open front of the supporting structure, the outer surfaces of said side walls being generally flush with the outer surfaces of the side walls of the supporting structure.

6 Claims, 2 Drawing Figures

DOCUMENT SHREDDING MACHINES

BACKGROUND OF THE INVENTION

It is conventional practice to mount a document shredding machine (such as of the kind described and illustrated in U.S. Pat. No. 4,426,044) on a supporting structure or stand, arranged to support the machine at a desired height from the floor and into which, beneath the machine, a bin can be positioned to receive shredded material produced by the machine. A simple form of stand comprises a generally horizontal support for the shredder which is supported by four legs, an aperture being provided in the horizontal support through which shredded material may fall.

Difficulties are encountered in such conventional structures, as follows:

(a) it is difficult to produce a design which is neat and tidy in appearance;

(b) it is difficult to ensure that the bin is placed in a correct position within the stand, to ensure that substantially all the shredded material produced by the machine falls into the bin;

(c) it is often difficult to provide a means for the ready disposal of material other than that subjected to a shredding operation: for example it has previously been suggested to provide a through-slot in the shredder itself, through which items of documentary material which may be disposed of without shredding, may be "posted" to fall directly into the bin. This adds to the cost of the shredding machine.

Additionally, it is always desirable to maximise the capacity of the bin.

SUMMARY OF THE INVENTION

According to this invention, there is provided a base unit for a document shredding machine, comprising an open-fronted supporting structure which comprises side walls and which provides a support surface on which a shredding machine may be mounted, and a bin comprising a rear portion having side walls and a rear wall and a front portion having side walls and a front wall, the front portion being wider than the rear portion such that, when the bin is placed in an operative, in-use position, the side walls of the rear portion lie between the side walls of the supporting structure.

Preferably, when the bin is in its operative position, the outer faces of the side walls of the front portion are generally flush with the outer surfaces of the side walls of the supporting structure.

In this manner, the shredding machine when supported on the base unit presents a neat and tidy appearance, and the bin offers increased capacity over a conventional bin.

The rear wall of the bin may provide a rear wall of the base unit, allowing (with the bin removed) ready access to the interior of the supporting structure for cleaning purposes.

Alternatively, in use, the rear wall of the bin may be in front of, and adjacent to, a rear wall of the supporting structure.

Preferably, the front wall of the bin is lower in height than the height of the side walls, thereby providing an opening (between the top of the front wall and the underside of the shredding machine) through which items may be placed directly into the bin.

Preferably, the front wall lies forwardly of the front face of the supporting structure and/or the shredding machine mounted thereon, the upper front corners of the side walls of the bin preferably being cut-away, to maximise ease of such direct access.

Such a construction additionally allows ease of gripping the bin (e.g. via the top of the front wall) for removal and replacing of the bin in its operative position.

This invention also provides a bin suitable for use as part of a base unit of the kind described above.

DETAILED DESCRIPTION OF A PREFERRED EMBODIMENT

Figure 1:
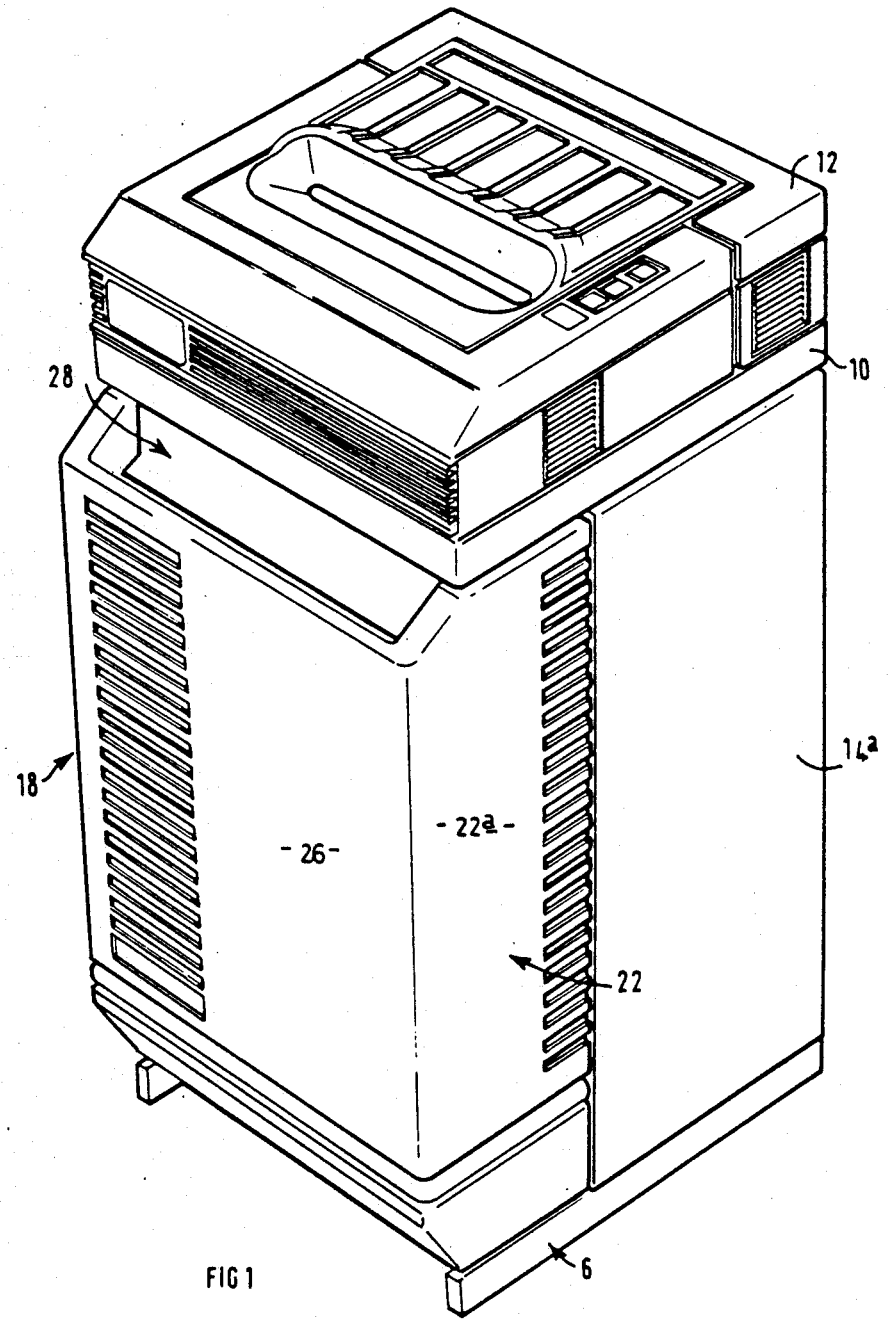
FIG. 1 is a perspective view showing a document shredding machine which has been selected for the purposes of illustrating the invention by way of example, in a position on the base unit.

The base unit which is the preferred embodiment of this invention comprises a frame-like supporting structure or stand comprising a running assembly comprising parallel-extending floor-engaging runners 6, a horizontal base plate 16 extending between rear portions of the runners, and support members 8 extending upwardly from the base plate 16. The supporting structure comprises a pair of side walls 14*a*, 14*b*, which side walls 14*a*, 14*b* are secured to the outside of the support members 8, thus providing an open front for the supporting structure. Upper edges of the side walls 14*a*, 14*b* and support members 8, and transverse cross-members secured between said upper edges, define and provide a horizontal support surface, upon which a document shredding machine 12 (such as of the kind described in our aforementioned patent specification) may be mounted. A base portion 10 of the machine 12 comprises a central aperture through which shredded material produced by the machine may fall. Said aperture is not obstructed by the cross-members. The machine 12 is positioned on the supporting structure by mounting bolts (not shown) which connect the base portion 10 to the supporting structure.

The machine 12 when so mounted extends forwardly from and overhangs the support members 8.

Figure 2:
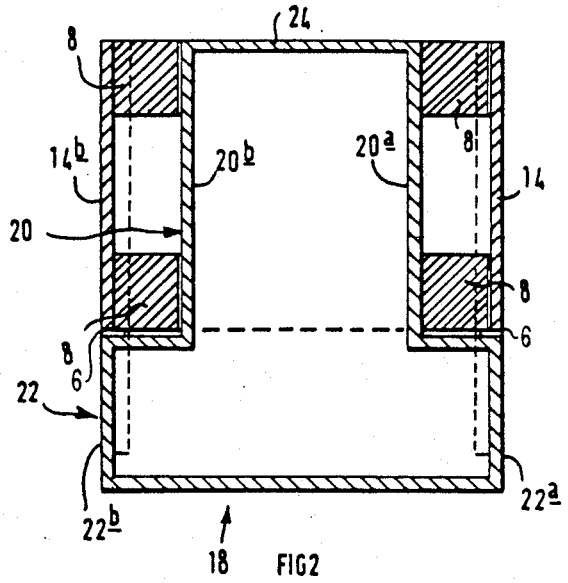
FIG. 2 is a horizontal sectional view of the base unit.

A container or bin 18 of the base unit may be positioned so as to rest upon, and be supported by, the base plate 16 and forward portions of the runners. The bin 18 comprises a rear portion 20 and a front portion 22 which is wider than the rear portion 20. Thus, when the bin 18 is inserted into the supporting structure, beneath the machine 12 in order to receive and collect shredded material falling from said aperture during operation of the machine 12, side walls 20*a*, 20*b* of the rear portion 20 lie between the support members 8 and between the side walls 14*a*, 14*b*, whilst the side walls 22*a*, 22*b* of the front portion project into the open front of the supporting structure, the outer surfaces of the side walls 22*a*, 22*b* being generally flush with the outer surfaces of the side walls 14*a*, 14*b* (see FIG. 2) which in turn are generally flush with sides of the machine 12, and the side walls 22*a*, 22*b* being close to, or in edge-to-edge abutment with, the side walls 14*a*, 14*b*.

In the preferred embodiment, a rear wall of the base unit is afforded by a rear wall 24 of the bin 18, but may if desired be afforded by a rear wall of the supporting structure, secured (for example) to the rearmost of the support members 8. In the latter case, upper edges of the side walls and the rear wall of the supporting structure may provide a machine-supporting surface, without use of said cross-members. (In another embodiment, the members 8 are omitted and the side walls and rear wall of the supporting structure are formed in one piece and support the machine.)

The front wall 26 of the bin 18 lies forwardly of the front face of the machine 12, and is cut-away in height so as to provide a downwardly-open opening 28 through which items may be placed directly into the bin 18. Upper front corners of the bin 18 are cut-away, to maximise ease of such direct access. Such a construction also permits ease of removal of the bin from the supporting structure, for the purpose of emptying the bin, for example by gripping the top of the front wall 26.

If desired, securing means (such as hooks) may be provided on the interior of the bin 18 to enable a bag (not shown), for reception of the shredded material, to be placed and supported therein.

Having now particularly described and ascertained the nature of our said invention and in what manner the same is to be performed we declare that what we claim is:

1. A base unit for a document shredding machine, comprising an open-fronted supporting structure which comprises side walls and which provides a support surface on which a document shredding machine may be mounted, and a container comprising a rear portion having side walls and a rear wall extending between the side walls, and a front portion having side walls and a front wall extending between the side walls, the front portion being wider than the rear portion such that, when the container is placed in an operative, in-use position, the side walls of the rear portion lie between the side walls of the supporting structure.

2. The invention claim 1 wherein the container is in its operative position, such that the outer faces of the side walls of the front portion are generally flush with the outer surfaces of the side walls of the supporting structure.

3. The invention of claim 1 wherein the rear wall of the container provides a rear wall of the base unit.

4. The invention of claim 1 wherein the rear wall of the container when in its operative position is in front of, and adjacent to, a rear wall of the supporting structure.

5. The invention of claim 1 wherein the front wall of the container is lower in height than the height of the side walls, thereby providing an opening through which items may be placed directly into the container.

6. The invention of claim 5 wherein the front wall lies forwardly of the front face of the shredding machine mounted on the supporting structure, the upper front corners of the side walls of the container being cut away, to maximise ease of direct access.

* * * * *